United States Patent [19]

Latham, Jr. et al.

[11] 4,421,503

[45] Dec. 20, 1983

[54] FLUID PROCESSING CENTRIFUGE AND APPARATUS THEREOF

[75] Inventors: Allen Latham, Jr., Jamaica Plain; Donald W. Schoendorfer, Brookline, both of Mass.

[73] Assignee: Haemonetics Corporation, Braintree, Mass.

[21] Appl. No.: 281,655

[22] Filed: Jul. 9, 1981

[51] Int. Cl.[3] ..... B04B 5/00

[52] U.S. Cl. ..... 494/17; 494/2; 494/27; 494/37; 494/45

[58] Field of Search ..... 494/1, 2, 3, 4, 5, 6, 494/10, 27, 85, 17, 34, 45, 37; 604/6, 131; 210/104, 112, 113, 115, 119

[56] References Cited

U.S. PATENT DOCUMENTS

| | | | |
|---|---|---|---|
| 3,347,454 | 10/1967 | Bellamy, Jr. et al. | 233/14 |
| 3,672,564 | 6/1972 | Schlutz et al. | 233/26 |
| 3,679,128 | 7/1972 | Unger et al. | 233/20 R |
| 4,146,172 | 3/1979 | Cullis | 494/17 |
| 4,268,393 | 5/1981 | Persidsky et al. | 210/516 |
| 4,322,298 | 3/1982 | Persidsky | 210/787 |

*Primary Examiner*—Robert W. Jenkins
*Attorney, Agent, or Firm*—Hamilton, Brook, Smith & Reynolds

[57] ABSTRACT

A pressure plate blood processing centrifuge apparatus is described. A plate is disposed adjacent a flexible bag in which blood is being processed. Under the influence of centrifugal force the plate, which is disposed inwardly nearer the center of rotation than the bag, expels a separated blood component from the bag into a receiver container. The container may be located (1) radially inward or (2) radially outward from the bag or (3) adjacent and equidistant from the center of rotation.

In the embodiment in which the container is located radially outward from the bag, a valve is provided which is responsive to the specific density of separated components to stop the flow. In other embodiments, the mass of the plate is selected so as to expel only the desired component. A plurality of alternate embodiments are described which make the apparatus useful for a variety of apparatus, such as plasma pheresis, platelet pheresis and cell-washing.

39 Claims, 20 Drawing Figures

FLUID PROCESSING CENTRIFUGE AND APPARATUS THEREOF

DESCRIPTION

1. Technical Field

This invention is in the field of fluid processing and more particularly relates to the centrifugal separation of fluid, such as blood, into two or more components.

2. Background Art

The desirability and/or necessity of separating whole blood into its components is gaining wide recognition. For example, it has been pointed out that limiting a transfusion to only those blood components necessary for a particular purpose preserves the available supply of blood, and in many situations is better for the patient. Additionally, in many therapeutic techniques, it is necessary to separate one blood component and to reinfuse that component after it has been processed or to substitute the same component from another source.

A copending U.S. patent application Ser. No. 005,126 to Allen Latham, Jr. filed Jan. 22, 1979, (now U.S. Pat. No. 4,303,193) describes a centrifuge (hereinafter the Latham centrifuge) for separating one or more components of blood into precise fractions. Such centrifuges operate under the principle that fluid components having different densities or sedimentary rates may be separated in accordance with such densities or sedimentary rates by subjecting the fluid to a centrifugal field.

In the Latham centrifuge, a flexible, disposable blood processing bag is mounted within the rotor of a self-balancing centrifuge rotor in a contoured processing chamber consisting of a pair of support shoes. The contoured chamber is designed to support the blood bag in a position whereby separated blood components traverse a short distance in the process of separation. A flexible displacer bag is employed as a movable diaphragm to apply pressure to the disposable blood bag in response to the introduction of displacement fluid into the displacer bag while the centrifuge rotor is either rotating or stationary. Such pressure tends to expel separated blood components from the disposable blood bag.

In a typical embodiment of the Latham centrifuge, the flexible blood processing and displacer bags are located radially outward from a centrally located collection chamber. The pressure required to expel blood components from the processing bag is given by the formula: $p=\frac{1}{2}(r_0^2-r_1^2)\rho w^2$ wherein $r_0$ is the radial distance from the center of rotation to the blood bag and $r_1$ is the radial distance from the center of rotation to the point of collection and w is the rate of rotation. For a 5.45 inch rotor radius and a 2 inch collection point radius with the centrifuge rotating at a speed of 2000 r.p.m. and an average blood component density of 1.05 $gm/cm^3$, a pressure of 55 psi must be generated by the displacer fluid to expel blood components from the processing bag into the collection chamber. In a typical application, where the blood processing bag is 6 inches by 10 inches, this force can amount to 3320 pounds and the generation of such large forces tends to move or push the contoured shoes apart.

Copending U.S. patent application Ser. No. 159,932 (now U.S. Pat. No. 4,304,357) to Donald W. Schoendorfer filed June 16, 1980 relates to an improvement in the Latham centrifuge whereby a weight, or pressure, plate (hereinafter the Schoendorfer pressure plate) is provided adjacent the inner wall of the support shoe nearest the center of rotation of the rotor. The mass of this pressure plate is chosen to at least equalize the inner pressure generated by the processing bags under the influence of centrifugal force. The pressure plate serves to maintain the contoured shoes securely against the blood processing bags.

Nevertheless, while the Latham centrifuge as modified by the Schoendorfer pressure plate operates satisfactorily for the purpose intended, a number of improvements are desirable to make the apparatus less complex, more flexible in application, and lower in cost.

For example, the requirement for a contoured shoe limits the volume of the blood processing bag to a size that will fit into the contours of the shoe.

Also, the necessity for introducing a displacer fluid creates additional complexity. It becomes necessary to either introduce a displacer fluid from an external source, as in the Latham centrifuge, or to provide a reservoir of displacer fluid on the rotor as in copending U.S. patent application Ser. No. 205,144 filed Nov. 10, 1980 to Donald W. Schoendorfer.

Additionally, in order to have blood processing bags which are disposable, the cost of fabricating the bags should be kept to a minimum. On the other hand, the bags must not rupture under the tremendous forces they are subjected to during the centrifuge process. If these forces are minimized, the bags can be constructed of low-cost materials.

A need therefore exists for a blood processing centrifuge apparatus which is capable of handling different volumes of whole blood, does not require a supply of displacer fluid and minimizes the pressure to which the blood processing bags are subjected.

DISCLOSURE OF INVENTION

The invention is particularly useful for various pheresis processes such as plasma pheresis or platelet-pheresis. The apparatus comprises a centrifuge of the type described in copending U.S. patent application Ser. No. 281,648 filed July 9, 1981 to Schoendorfer and Avery and hereinafter referred to as a "Self-Balancing Centrifuge". The elements of the invention are mounted on the rotor of a Self-Balancing Centrifuge. One of these elements is a first container in the form of a flexible bag containing the whole blood to be centrifugally separated. This first container is located on the rotor a suitable distance away from the center of rotation of the rotor. A second container is disposed adjacent the first container and in fluid communication with the first container. This second container is adapted to receive one or more of the centrifugally separated components of the whole blood. In the embodiments described, this second container is shown as a flexible bag, however, unlike the first container it need not be flexible.

A pressure plate in the form of a body of material, such as a metal plate, having a predetermined mass is slideably disposed in the radial direction between the first bag and the center of rotation of the rotor. This pressure plate is suspended so that it is free to move radially against the first bag when subjected to the centrifugal forces generated by rotation of the centrifuge. The pressure plate has a predetermined mass sufficient to at least initiate a flow of separated fluid component from the first bag to the second bag as the pressure plate presses against the first bag during rotation of the centrifuge. The pressure plate has a predetermined mass distribution and shape adapted to pool the separated first blood component in the area of the output of the fluid communication to the second bag. The pressure plate is adapted press against the first bag and cause the radius at the output of the first bag to be located at the minimum radius of the first bag in the centrifuge.

A suitable timing mechanism, such as that described in copending U.S. patent application Ser. No. 281,650 filed July 9, 1981, is provided for controlling the flow of components from the first to the second bag until sufficient separation has been achieved.

In one embodiment of the invention, the first bag and second bag are located adjacent each other on the rotor with the first bag positioned radially inward from the second bag. In this embodiment, a siphon effect is created when flow is initiated from the first bag to the second bag due to the difference in centrifugal forces to which the bags are subjected because one bag is located nearer the center of rotation than the other. Thus, flow from the first bag to the second bag, once initiated, will continue regardless of the specific gravity of the separated blood component. In this embodiment, therefore, a valve is provided in accordance with copending U.S. patent application Ser. No. 281,649 filed July 9, 1981. This valve hereinafter called a Pheresis Valve may be in the form of a stopper having a specific gravity less than the component or components to be retained in the first bag, but greater than the component or components to be expressed into the second bag. The stopper may be a free-floating ball, a ball contained within guide channels or a flap attached at one end to an interior surface of the blood processing bag adjacent to its outlet port, or other similar stoppers.

In another embodiment of the invention, the first and second bags are disposed adjacent each other substantially equidistant from the center of rotation of the rotor. The mass of the pressure plate positioned against the first bag is such that it is of sufficient value to create just enough force against the first bag to express only the less dense component(s) from the first bag to the second bag.

In a third embodiment, the second bag is located closer to the center of rotation than the first bag and the mass of the weight plate is such that it produces sufficient pressure to express specific lighter components of blood in the second bag but lacks sufficient pressure to express specific heavier components from the first bag.

Thus, in the various embodiments of the invention, a low-cost aseptic, disposable apparatus is provided in combination with a centrifuge system wherein blood components may be automatically separated from whole blood without the need for displacer fluid or contoured shoes. The apparatus of the invention is able to accomodate various volumes of whole blood for processing and may be operated by unskilled personnel since human intervention is minimized.

These and other advantages will become apparent from the following description of the best mode for carrying out the invention.

BEST MODE FOR CARRYING OUT THE INVENTION

As used herein, the following terms are defined to mean:

"First blood component"—one fraction of blood which it is desired to separate from another fraction;

"Second blood component"—another fraction separated from blood which is the balance after first blood component has been separated therefrom;

"Platelet-rich plasma" or "PRP"—a fraction of plasma which is rich in platelets;

"Platelet-poor plasma" or "PPP"—a fraction of plasma which is poor in platelets;

"Packed red blood cells" or "RBC"—a fraction of blood which is rich in red blood cells.

In general, it may be seen that this invention comprises an apparatus and process for separating blood into components thereof in a centrifuge. The invention is particularly suitable for various pheresis processes, such as, (a) plasma-pheresis, wherein whole blood is removed from a donor, separated into cell-free plasma and packed red blood cells followed by reinfusion of the autologous red cells or (b) platelet-pheresis, wherein whole blood is removed from a donor and separated into three components, platelet-rich plasma (PRP), platelet-poor plasma (PPP) and packed red blood cells (RBC) followed by reuniting the PPP and RBC which are returned to the donor, or similar component separation where the donor donates a unit of blood which is separated into plasma and packed red cells; plasma, platelets and packed red cells; or plasma, platelets, white cells and packed red cells.

Figure 1:
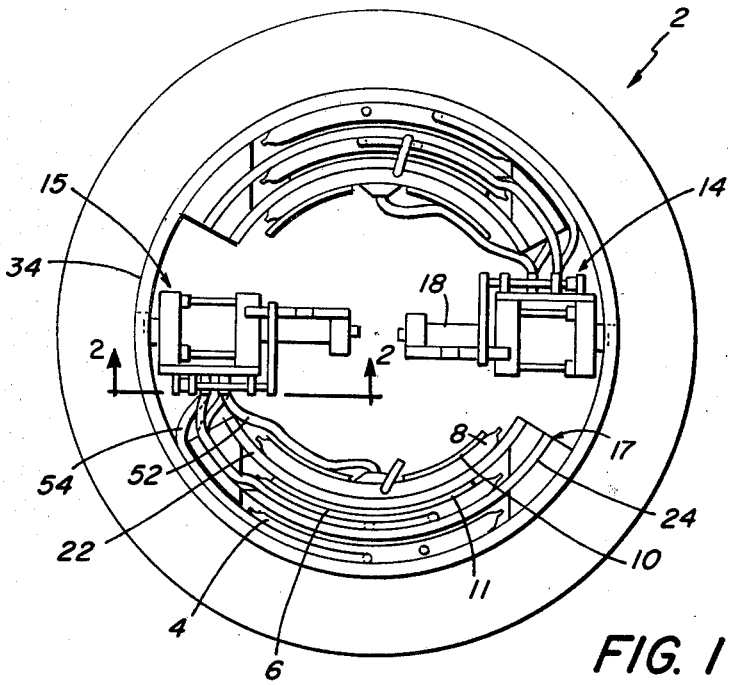
FIG. 1 is a top view of a centrifuge in accordance with the invention.
Figure 3:
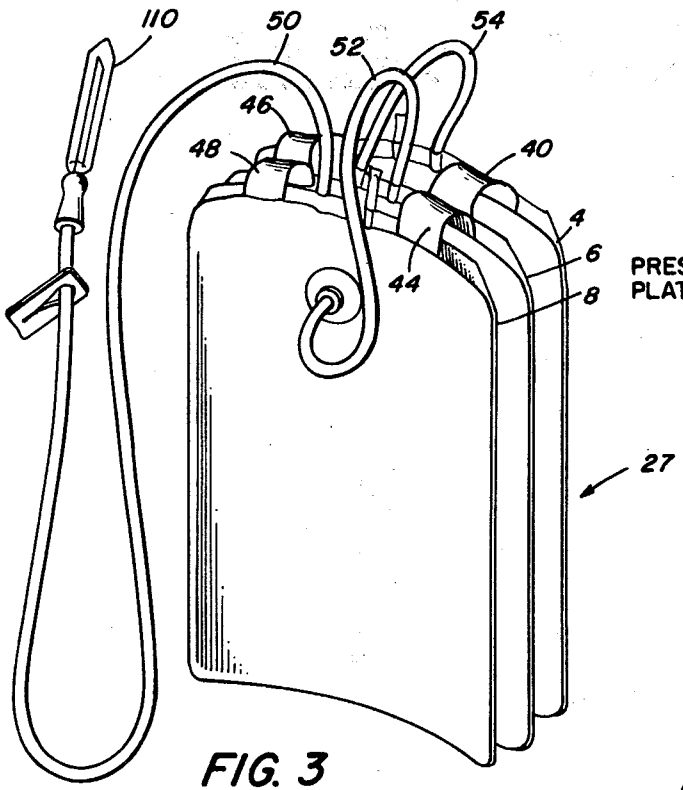
FIG. 3 is a perspective of a disposable software set of the invention.

For purposes of explanation, the invention will generally be described in connection with component separation of whole blood into plasma, platelets, and packed red cells by centrifugal separation in accordance with the specific gravity of the components but the invention is not intended to be limited thereby. For example, separation in accordance with the sedimentation rate of individual components is also contemplated by this invention In the apparatus of FIGS. 1–11, the following main items utilized in the invention are illustrated:

(1) a Self-Balancing Centrifuge 2 (FIG. 1);

(2) a cassette 29 (FIG. 4) for holding the sterilized blood processing software 27 (FIG. 3);

(3) a cassette software package 27 (FIG. 3) consisting of a whole blood bag 8 containing the correct volume of anticoagulant (CPD-A1), a PRP bag 6 and a PPP bag 4, suitably interconnected by tubing, and a phlebotomy needle 110 connected to the whole blood processing bag 8;

(4) a timer mechanism 15 (FIG. 2) such as the Hydraulic Timer Clamp described and shown in the aforementioned copending U.S. patent application Ser. No. 281,650 filed July 9, 1981;

(5) one or more pressure plates 10 (FIG. 4); and (6) a Pheresis Valve 117 (FIGS. 9–11) incorporated into the cassette software package.

The above-mentioned items and their interrelationship will now be described in detail in connection with the figures.

It is contemplated that a Self-Balancing Centrifuge, or equivalent, will supply the necessary centrifugal force for blood processing in accordance with the invention and a Pheresis Valve, or equivalent, will provide the means for automatically terminating flow once a precise cut is achieved between components. The invention as described herein is not, however, intended to be limited to use of such devices.

For simplicity, only a top view of the Self-Balancing Centrifuge 2 is shown in FIG. 1. The apparatus shown in FIG. 1 is adapted to conduct two pheresis processes simultaneously and therefore has duplicate process apparatus within each half of the rotor of centrifuge 2. Rigid cassettes 17 are mounted on opposite sides of the rotor of centrifuge 2 within cylindrical housing 34.

Figure 4:
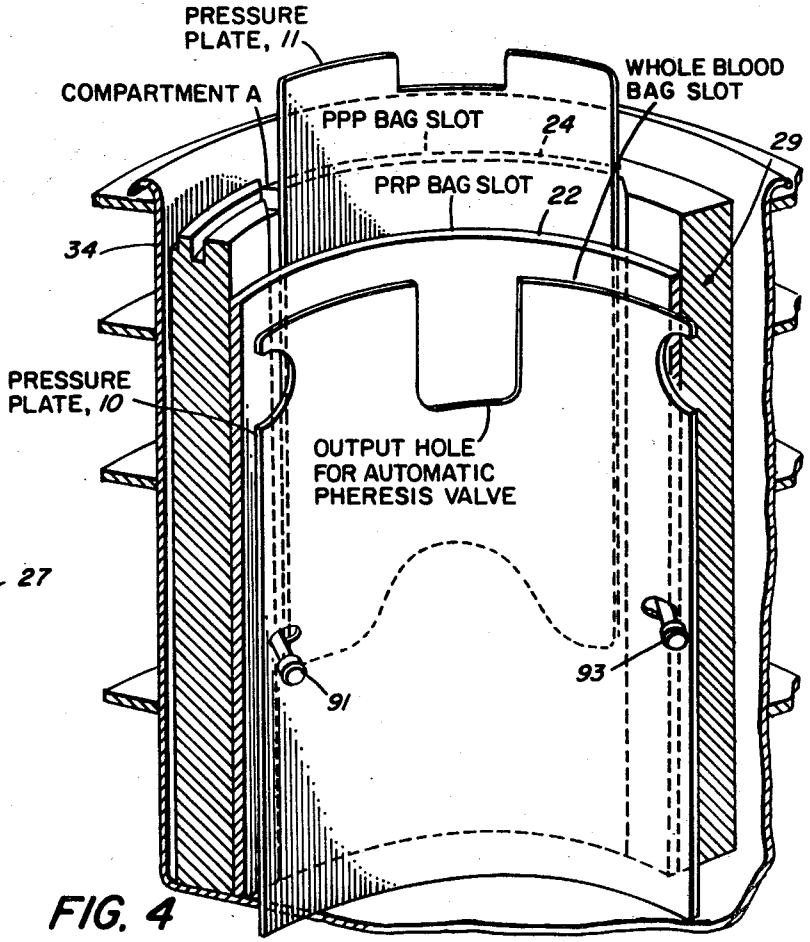
FIG. 4 is an enlarged exploded perspective view of the cassette as mounted in the rotor but without the disposable software set.

Each cassette 17 consists of a stand, or rack, which is partitioned into three annular sections by two vertically positioned support members 22 and 24 each having a shape generally described by a segment of a cylinder with a radius corresponding to the radius to the center of rotation of the centrifuge rotor (as shown in detail in FIG. 4).

A sufficient volume of anticoagulant may be initially stored in the whole blood bag 8 or the appropriate anticoagulant ration may be pumped with the blood as described in copending U.S. patent application Ser. No. 182,510 filed Aug. 29, 1980 to Gilcher et al.

After being filled with whole blood, tube 50 is heat sealed close to bag 8 and the section of tubing 50 containing the phlebotomy needle is disconnected and discarded. A pressure plate 10 is suspended adjacent the whole blood bag 8 on two mounting bolts 91 and 93 (shown in FIG. 4) on the side nearest the center of rotation and in such a manner that the plate 10 is free to move or float against the whole blood bag 8 under the influence of centrifugal force when the rotor is spinning. Bag 8 is loaded in the cassette while pressure plate 10 is moved radially inward. This allows sealed bag 8 filled with anticoagulated whole blood to be inserted into the space between the plate 10 and the cassette wall 22. The PRP bag 6 is inserted into the next section of the cassette and the PPP bag 4 in the last section, which is the section furthest removed from the center of rotation.

An additional pressure plate 11 may be provided adjacent the side of the PRP bag 6 nearest the center of rotation. As will be described in detail later, this pressure plate cooperates with a flexible elastomeric gasket to isolate platelets and prevent them from flowing out the PPP tube 54.

The respective tubing 52 and 54 interconnecting the PRP bag 6 with the whole blood bag 8 and the PPP bag 4 with the PRP bag 6 are inserted in respective clamps 31 and 35 of the hydraulic timer mechanism 15.

In operation, the PRP tubing 52 and PPP tubing 54 are initially clamped "off" by operation of the hydraulic timer mechanism 15. The centrifuge 2 is then brought to a suitable speed, for example, 2000 r.p.m., for a sufficient time to allow centrifugal separation of PRP and packed RBC's within bag 8, i.e. about one minute. The hydraulc timer 15 then unclamps the PRP tubing 52 by rotating clamp 31.

The pressue exerted by the weight plate 10 on the whole blood bag 8 as the rotor continues to spin is sufficient to force the plasma separated in bag 8, which is of lower density, out the exit port of the bag and into PRP tubing 52, which is centrally located on the side of the whole blood bag nearest the center of rotation. The weight plate is needed here as initially the PRP must be pushed toward the center of rotation of the rotor as it leaves the blood bag.

Once fluid starts flowing from the whole blood bag 8 to the PRP bag 6 a siphon effect is created, inasmuch as the whole blood bag 8 is located at a shorter radius than the PRP bag and therefore at a higher potential energy.

Under these conditions, once the PRP tubing 52 is filled with fluid, the difference in potential energy from the whole blood bag 8 to the PRP bag 6 favors flow in that direction and pressure from the pressure plate 10 is no longer required to maintain flow. However, the plate still serves a useful function to prevent the buildup of excessive dynamic waves on the inner wall of the blood bag.

This siphon effect is advantageous in that the mass of the pressure plate 10 and the pressure that it generates in the centrifugal force field is minimized. Therefore, the pressure holding capacity of the blood bags is greatly reduced and lower cost disposable plastic bags may be utilized. On the other hand, once initiated, fluid flow will continue, therefore, means are required to automatically stop the flow of plasma before any RBC is lost.

Figure 6:
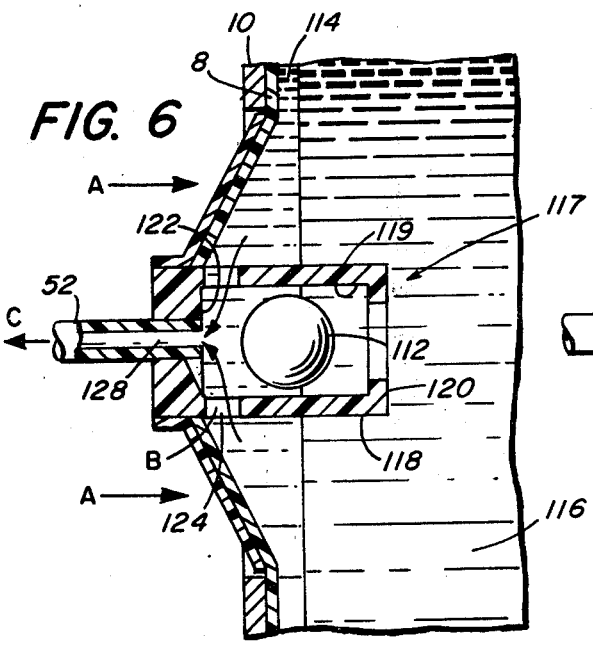
FIG. 6 is a partial cross-section along the lines 6—6 of FIG. 5 showing the details of the Pheresis Valve used in the invention.

In the preferred embodiment shown in FIG. 6 of the invention, this automatic flow control means (shown generally at 117) is provided by a Pheresis Valve with a ball stopper 112 having a specific gravity greater than PRP (about 1.03) but less than that of packed cells (about 1.10). This ball stopper is located in the whole blood bag 8 so as to float on top of the packed RBC layer 116. A separated first blood component, such as plasma layer 114, occupies the radially inner portion of the flexible blood-processing bag 8 whereas separated second blood component such as RBC layer 116, occupies the radially outward portion. As illustrated, the pressure plate 10 applies a force in the radially outward direction (arrows A) which tends to collapse the flexible blood processing bag 8 and expel first blood component (plasma layer) 114 therefrom.

The stopper ball 112 is contained within a guide member 119 formed by a cylindrical wall member 118, an end wall member 120, and a stopper ball seat 122. The cylindrical wall member 118 has one or more input ports 124 located relatively close to the stopper ball seat 122. Separated first blood component (PRP) enter the input port(s) (as shown by arrows B) in the cylindrical wall member 118 and leave the flexible blood bag 8 and flow through output port 128 into tubing 52 in the direction of arrow C to PRP bag 6.

The inner diameter of the cylindrical wall member 118 is chosen such that the stopper ball is free to move axially within guide 119 in the direction C, but not radially. The end wall member contains one or more end wall ports 124. When the depth of the first blood component 114 is greater than the depth of the end wall member within the flexible blood processing bag 8, the stopper ball 112 rides on top of, and is supported by, the end wall member.

Figure 7:
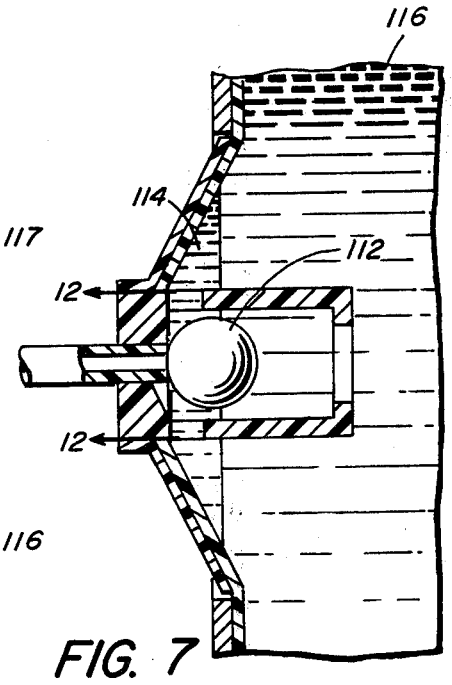
FIG. 7 is a further cross-sectional detail showing the Pheresis Valve of FIG. 6 in the closed position.

As the first blood component 114 is expressed from the flexible blood processing bag 8 by the force of pressure plate 10 moving in the direction A the interface between said first and second components approaches the output port 128, of the flexible whole blood bag 8. The stopper ball 112 also approaches the output port 128. Eventually, the stopper ball 112 is carried into contact with the seat of guide 119 and forms a seal with the port. This is illustrated in FIG. 7 wherein substantially all of the first blood component 114 has been expelled from the flexible whole blood bag 8 and all that remains is second blood component 116. When the stopper ball 112 comes into contact with the outlet port, flow is thus immediately halted automatically.

As previously noted, the specific gravity of the stopper ball 112 is chosen so that it floats on the interface between the first and second blood components 114 and 116. That is, the stopper ball 112 has a specific gravity greater than the specific gravity of the second blood component 116. For example, if the first blood component is plasma which has a specific gravity of about 1.03, and the second blood component comprises mostly RBC which has a specific gravity of about 1.10, the specific gravity of the stopper ball 112 is preferably chosen to be about midway between these values. Typical materials for the ball stopper is Dow Corning silicone which comes in specific gravities within this range and can be supplied with FDA Class VI certification, or conventional polystyrene.

While the embodiments thus far described have operated on the principle that the blood component with the greater density, for example RBC, is retained in the container and the less dense component PRP is allowed to flow to another container, in some applications it may be desirable to reverse the process. For example, if the outlet port and valve seat is located adjacent the more dense component, and a ball float with an intermediate density is desposed to float on the interface, as the more dense component is expressed out the port the interface and ball would move toward the valve seat and close in the manner previously described.

It should be noted that if air bubbles accumulate in any sections of the PRP tubing 52 which are extending radially toward the center of rotation (increasing in radius from the whole blood bag 8) a vapor lock may occur in the line. In the embodiment thus far described, the pressure required to initiate the flow of plasma 114 from the whole blood bag 8 to the PRP Bag 6 through tubing 52 is developed by the centrifugal force on pressure plate 10. Once the flow of plasma has begun and the PRP tubing 52 is full, the siphon effect previously described dominates the flow. This is one of the advantages of the inner/outer bag geometry of this first embodiment. High flow rates can be reached without the need for a heavy pressure plate 10. On the other hand, if a vapor lock occurs in tube 52 flow will either be diminished or stopped completely. Since the introduction of air in small quantities into the software set is probably unavoidable, a solution to this problem is imperative.

Figure 2:
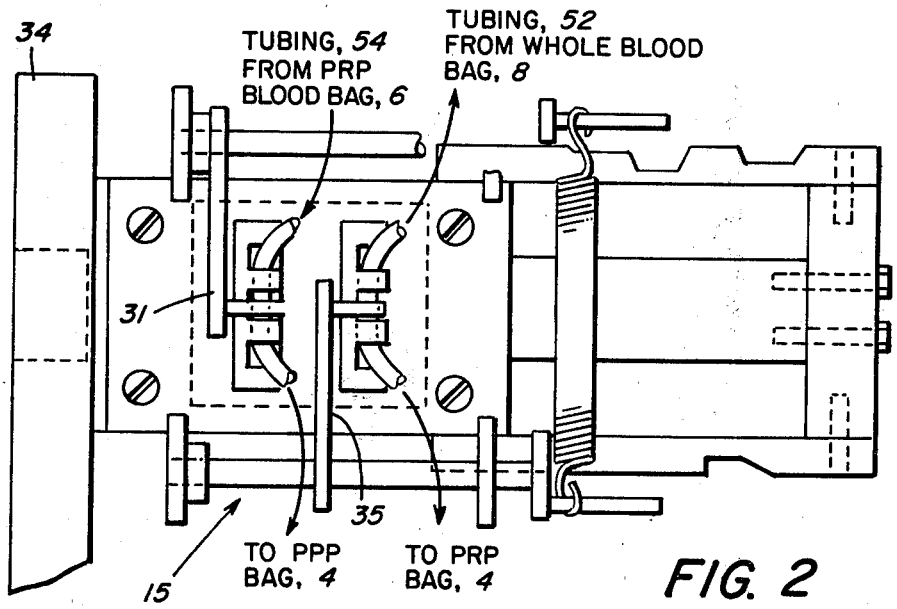
FIG. 2 is a partial side view of the hydraulic timer clamp 15 of FIG. 1 taken along the lines 2—2 of FIG. 1.
Figure 5:
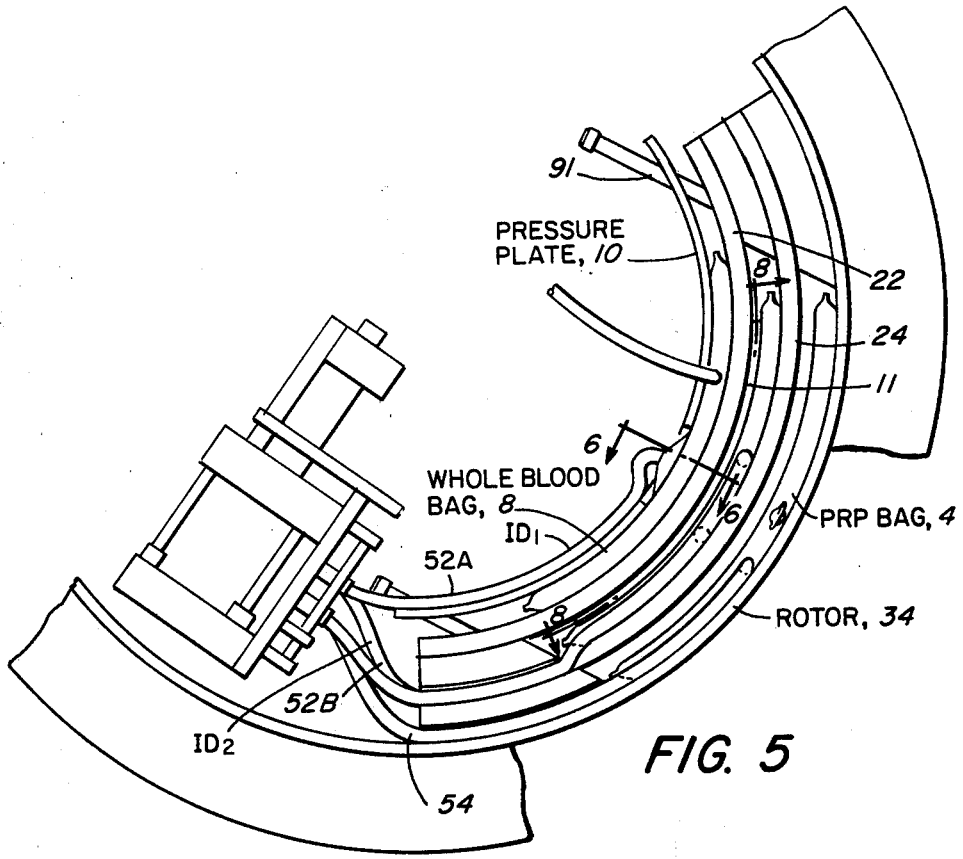
FIG. 5 is a diagramatic sectional illustration of the details of the cassette and software set of FIG. 1 interconnected with the hydraulic timer mechanism of FIG. 2.

In the embodiment shown in FIGS. 2 and 5, a simple and inexpensive solution is illustrated. As shown in FIG. 5, the output port for tubing 52 on whole blood bag 8 is oriented by pressure plate 10 to be at a minimum radius with respect to the radius of the bag 8 from the center of rotation. Thus, any air in the bag 8 will collect in the area of the output port. When tubing 52 is unclamped by clamp 31 of mechanism 15, this air must flow out of the bag 8 and into the PRP bag 6 before any plasma will flow.

As indicated in FIG. 5, the section of tubing labelled 52B has an unusually small internal diameter, $ID_2$ as compared to a normal inner diameter ID on the remaining section 52A of tubing 52. Section 52B is the section of tubing which extends radially outward from the bag 8 to the clamp 15 and therefore fluid in this section is in effect forced to flow downhill with the centrifugal force. With the internal diameter reduced in this section, the velocity of flow increases and air bubbles which would otherwise be trapped in this section are forced to flow "down" the tube 52 to PRP bag 6. A similar reduced diameter tubing is not required in tube 54 as there is no need for an umbilical fitment on PRP bag 6 as there was in the whole blood bag 8. Because of this, air in bag 6 is not localized in the area of the output port and therefore is not expressed from bag 6 with the PPP.

Figure 8A:
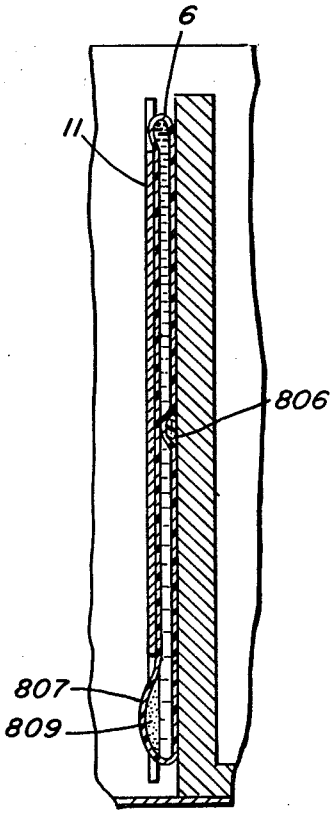
FIG. 8A is a cross-section taken along the lines 8A—8A of FIG. 8.

We have thus described how the packed red cells 116 may be separated from the plasma 114 in whole blood bag 8 and the plasma expressed/siphoned over to PRP bag 6 and the flow of the plasma automatically stopped by the Pheresis Valve 117. The details of the process and apparatus for separating platelets from the plasma 114 in PRP bag 6 and expressing the PPP to PPP bag 4 will now be described in detail primarily in connection with FIGS. 8 and 8A.

Because of the nature of centrifugal separation, the first plasma that enters PRP bag 6 from whole blood bag 8 through tubing 52 is poor in platelets whereas the last plasma that enters PRP bag 6 is rich in platelets. These platelets (See FIGS. 8 and 8A) tend to pool in bag 6 in the area labelled 804, close to the PRP input tube 52 which is adjacent the PPP output tube 54. Loss of these platelets from the PRP bag 6 could occur if they were allowed to mix with the rapid flow of PPP out of bag 6 through tube 54. This would result in a lower yield of platelets in the PRP bag 6 and a platelet contamination in the PPP bag 4.

Consequently, a barrier 802 is provided intermediate the PPP output port and the PRP input port. This barrier may be conveniently made by conventional heat or R.F. sealing during the fabrication of the bag 6. The barrier should preferably extend along the length of the bag from the input ports to about one inch from the bottom as shown by the vertically extending solid and dotted lines in FIG. 8.

With the barrier provided in PRP bag 8, the PPP must now circulate around the barrier. There is, therefore, less disruption of the platelet concentrate in area 804 and platelets which are disrupted have a longer time to re-separate out as the plasma flows around the barrier 802.

Figure 8:
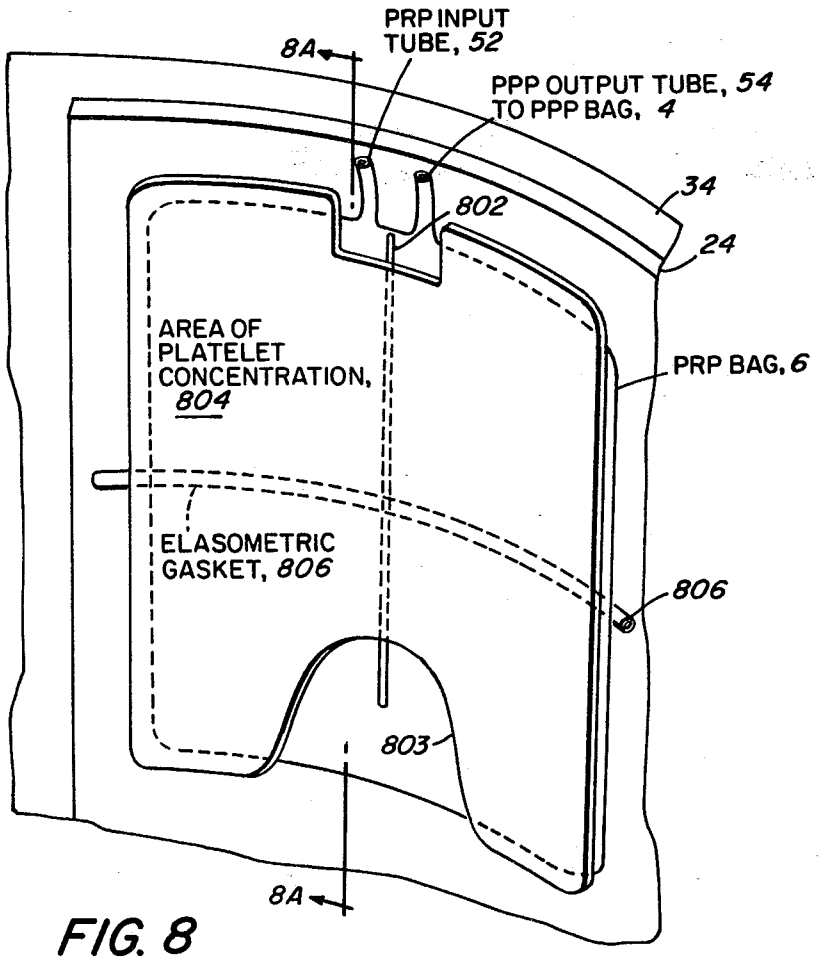
FIG. 8 is an enlarged perspective view of a detail of the invention taken along the lines 8—8 of FIG. 5.

FIG. 8 also shows a preferred embodiment of the apparatus for fixing the final volume of the platelet concentrate (PRP) left in PRP bag 6. A thin but rigid pressure plate 11, such as 0.060" thick aluminum, is disposed adjacent PRP bag 6 on the side nearest the center of rotation.

Pressure plate 11 is free to move radially against PRP bag 6 under the influence of centrifugal force. The plate 11 is of sufficient size to eclipse one side of bag 6. The other side of PRP Bag 6 abuts fixed support member 24. A flexible elastomeric gasket 806 is affixed to support member 24 of cassette 17 tangential to the axis of rotation.

In operation, the PRP/PPP separation apparatus functions as follows:

After the PRP is separated and expressed/siphoned to the PRP bag 6 and flow is automatically stopped from the whole blood bag 8 by the automatic pheresis valve mechanism 117, the centrifuge 2 continues to spin while the PPP tubing 54 is held clamped by the hydraulic timer mechanism 15 for a period of time sufficient to allow separation of platelets and PPP. The time and speed to produce separations depends on the diameter of the centrifuge rotor and location of the bags. In the embodiment shown, a rotor diameter of 11 inches and a speed of 2000 r.p.m. produced adequate separation of PRP into platelets and PPP within 2 minutes. Meanwhile, during the separation spin, the PPP tubing 54 is automatically filled with PPP priming the siphon between PRP bag 6 and PPP bag 4.

After the separation spin, PPP tubing 54 is unclamped. As separated PPP flows from the PRP bag 6, the bag tends to collapse and pressure plate 11 approaches the elastomeric gasket 806 and eventually compresses the PRP bag against the gasket forming a transverse barrier along the length of gasket 806 thereby preventing further flow out the PPP tube thus isolating the remaining plasma, which, for the reasons previously given, will be rich in plasma.

The location of the elastomeric gasket in relation to the height of the PRP bag 6 and the thickness of the gasket is adapted to isolate a predetermined volume of plasma in the PRP bag 6. For example, in the embodiment of FIG. 8, 50 milliliters can be retained with a 1/16" ID by ⅛" OD tube gasket located one-third down the height of a 6"×10" bag.

It should be noted that pressure plate 11 also functions to prevent formation of dynamic waves on the inner surface of the PRP bag 6. In addition, the mass of the pressure plate may be varied by adding or subtracting mass and thereby controlling the flow of PRP from the whole blood bag. A more massive pressure plate on the PRP bag in relation to the mass of the pressure plate on the whole blood bag 8 will decrease the rate of PRP flow since it will increase the back pressure on PRP bag 6.

Pressure plate 11 may also be fashioned with a section 803 cut out on the side opposite the PPP and PRP tubes 52 and 54. This cut out section 803 allows the PRP bag to bulge out within the cut out section. Since this bulge is pushed radially inward, any air 809 in PRP bag 6 will be pushed into the bulge and be isolated from the PPP output tube 54. This acts as a safety factor to prevent the vapor lock effect from occurring in tube 54.

After the PPP has been collected in PPP bag 4, clamps 31 and 35 of timer mechanism 15 clamp PRP tube 52 and PPP tube 54 and the centrifuge rotor is brought to rest. The end result of this process is a bag of packed RBC, a bag of PRP in bag 6 and a bag of PPP in bag 4.

This completes the overall system description of a first embodiment of the invention. What follows now is a description of various alternate embodiments of some of the apparatus used in the invention.

Figure 9:
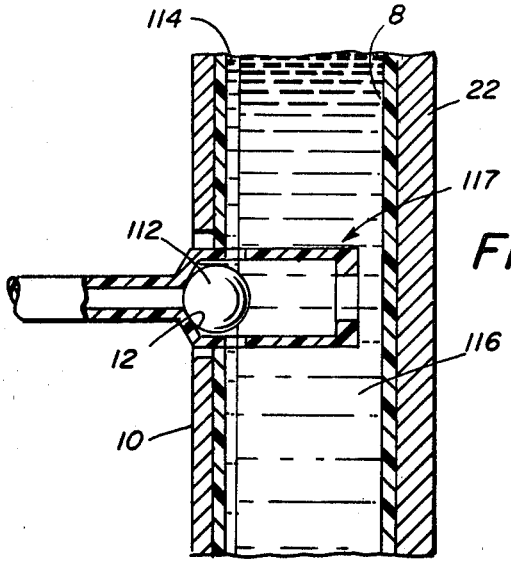
FIG. 9 is a partial cross-section similar to FIG. 6 showing the details of a Pheresis Valve having a large diameter ball stopper.
Figure 10:
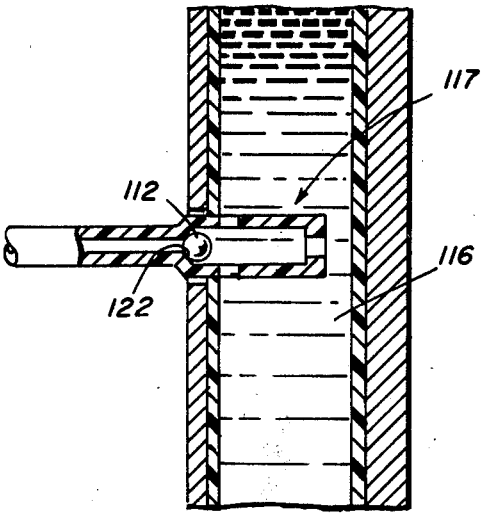
FIG. 10 is a cross-section similar to FIG. 9 showing a Pheresis Valve with a small diameter ball stopper.

Referring now to FIGS. 9 and 10 (in which the numbers used are the same for parts corresponding to parts previously described in connection with FIG. 6) the effect of the size of the stopper ball 112 on the precise blood cut achieved is illustrated. In FIG. 9, the ball stopper 112 has a relatively large diameter and tends to contact and seal outlet port 128 prior to the expulsion of all the first blood component 114. If the first blood component 114 is plasma and the second blood component 116 is packed red cells, the effect of the larger diameter ball stopper 112 is to lower the hematocrit of the second blood component remaining in the blood processing bag 8. On the other hand, when a relatively smaller diameter ball stopper is employed, such as in FIG. 10, a much smaller amount of PRP 114 remains in the flexible blood processing bag 8. Thus, the hematocrit of the second blood component or packed red cells 116 is raised.

Figure 11:
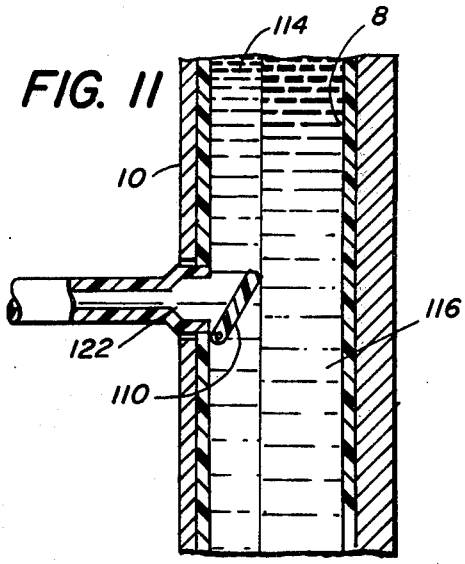
FIG. 11 is a cross-sectional detail of a Pheresis Valve using a flap valve instead of a ball valve.

FIG. 11 shows an alternative embodiment of a Pheresis Valve for sealing the outlet port of a flexible blood processing pouch. In this embodiment, a hinged flap 110 has one end joined to an interior surface of the flexible blood-processing bag 8 at a position adjacent to the outlet port 128. The hinged flap 110 is of a density similar to that of the stopper ball 112 and operates in a manner similar to the stopper ball 112 previously described in that it floats at the interface between first blood component 114 and second blood component 116. Thus, as this interface approaches the outlet port, the hinged flap is carried into contact with the outlet port 128 thereby creating the required seal.

In some applications of the invention, such as cell washing or gaining maximum plasma yield, it is desirable to be able to re-open the Pheresis Valve 117 after it closes. In the embodiments heretofore described, once the valve closes, it is prevented from re-opening by the high negative pressure of the fluid downstream (in the direction C of FIG. 6) from the valve.

One way to make the valve re-open is to minimize the negative pressure force in the direction C of FIG. 6 and maximize the positive buoyancy force in the opposite direction created by the volume of fluid left in the bag 8. This could be accomplished by decreasing the cross-sectional area of the output tube 52 and increasing the size and therefore the buoyant volume of the valve float. The latter is undesirable since it increases the manufacturing cost of the bag and the former increases the disruptive shear stresses of blood components flowing through the valve, thereby increasing the probability of occlusions.

Figure 12:
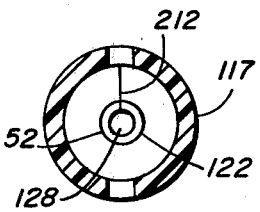
FIG. 12 is a sectional view showing the valve seat details of the ball valve of FIG. 7 taken along lines 12—12 of FIG. 7.

A better solution to this problem is shown in FIG. 12 which is a cross-sectional view taken along the lines 12—12 of FIG. 7. As shown in FIG. 12, the valve seat 122 is made leaky by one or more tiny slots 212 on the valve seat 122 so that the negative downstream pressure is dissipated. The slots leak about 1 milliliter per minute when the ball valve is seated.

The operation of the slotted valve may be described as follows in connection with FIGS. 9 and 12:

First, the ball stopper 112 approaches the valve seat 122 as it floats on the interface between RBC 116 and plasma 114. Eventually, the ball stopper 112 lodges in the valve seat and cuts off the flow of plasma 114 through PRP tubing 52. As the centrifuge continues to spin, more plasma 114 is separated from whole blood and the interface between plasma and RBC moves away from the valve seat. At the same time, some of the plasma 114 leaks through the slits 212 into the output tube 52 dissipating the negative pressure on that side of the ball stopper. At some point, the buoyancy force on the stopper 112 becomes greater than the negative pressure in the tube 52 and the valve mechanism 117 reopens allowing the flow of plasma to resume. The apparatus may be permitted to re-cycle as described above until substantially all the plasma is separated from the whole blood.

Figure 13:
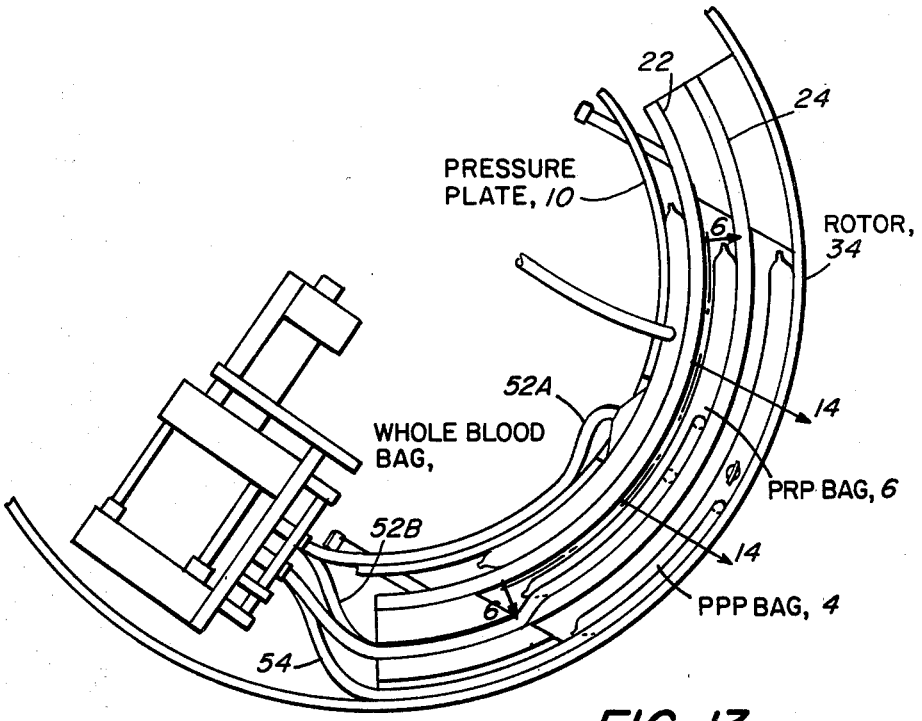
FIG. 13 is a diagrammatic sectional illustration of the details of an alternate embodiment of the cassette and software set of FIG. 1 integrated with the hydraulic timer mechanism of FIG. 2.
Figure 14:
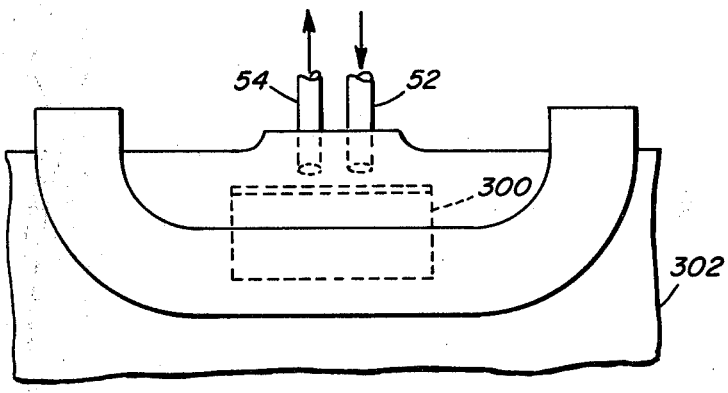
FIG. 14 is a view of FIG. 13 taken along lines 14—14 of FIG. 13.

An alternate embodiment of the invention in which the PRP bag pressure plate 11 is eliminated is shown in FIGS. 13 and 14. In the embodiment shown in FIGS. 13 and 14, the PRP input port for tubing 52 and output port for PPP tubing 54 are located at the top of PRP bag 6. The timer clamp 15 is located as close to rotor housing 34 as possible. The inner diameter of the PPP tubing 54 is large enough so that the capillary air bubble surface tension inside the tube is less than the centrifugal force pressure on the fluid in the tube.

Initially, the PPP tube 54 and bag 4 are empty. As plasma is expressed into the PRP bag 6, the air in the PPP tubing 54 is locked by the plasma. However, the air surface in the tube 54 cannot withstand the outward pressure of the plasma and this air is displaced out of the PPP tubing 54 into bag 6.

After the platelets are settled out of the plasma in PRP bag 6 and become deposited on the outer wall of bag 6, the tubing 54 is unclamped by clamp 35 of timer 5 and PPP is siphoned from PRP bag 6 into PPP bag 4. Ramp 300 is provided on partition wall 24 adjacent the exit port for PPP tubing 54 on bag 6. The separated platelet concentrate in bag 6 is substantially prevented from exiting the PRP bag 6 by this ramp. A mass clamp 302, such as a 0.050 thick strip of plastic, may be disposed adjacent the inner wall of bag 6 opposite the ramp and near the outlet to PPP tubing 54. This mass clamp 302 will terminate PPP flow at a predetermined volume. Such volume may, for example, be at a ratio of 50 ml of plasma for each single unit platelet concentrate left in PRP bag 6 as presently specified by clinical standards.

By proper design of the angle of inclination of ramp 300 and its location and the weight and location of mass 302, flow may be terminated at this 50 ml level. The clamp mass 302 has very little influence on the PRP bag 6 until sufficient PPP has been siphoned out of the bag thereby bringing the inner walls of the clamp mass close together, i.e., within 0.001".

When this occurs, negative Bernoulli pressure due to the high flow rate of PPP out tubing 54 pulls the two inner walls of bag 6 together, terminating flow. Once the flow ceases, the negative pressure (previously described) from the siphon effect is large enough to keep the walls of the bag 6 under the clamp mass sealed together.

Figure 15:
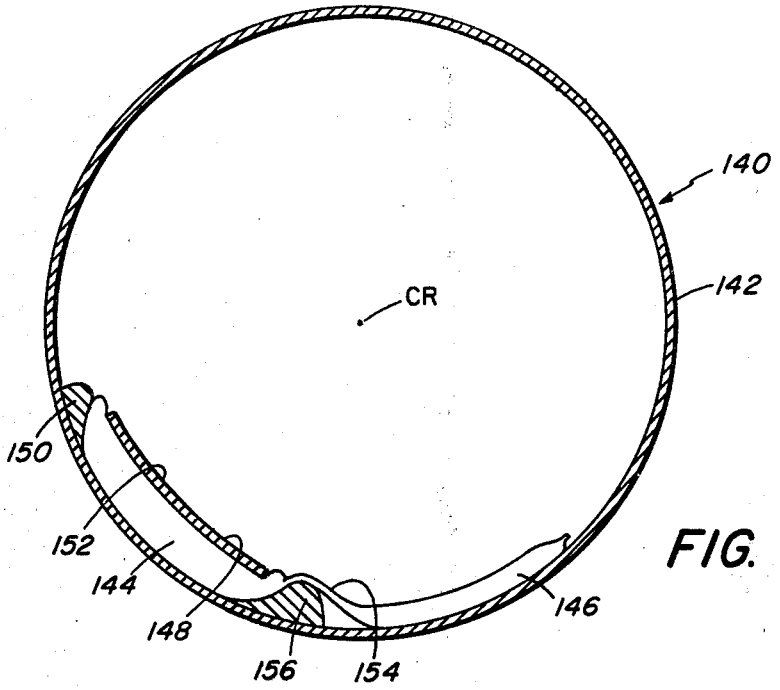
FIG. 15 is a simplified schematic top view of a pressure plate type centrifuge in a side-by-side configuration.

Instead of locating the first blood processing bag nearer to the center of rotation than the second bag (which as aforesaid may merely be a rigid receptacle for receiving separated components) as in the embodiments heretofore illustrated, it may be desirable to have a "side-by-side" arrangement in which the first and second bags are located along the periphery of the rotor housing equidistant to the center of rotation as diagrammatically illustrated in FIG. 15

In the embodiment of FIG. 15, a centrifuge 140 of the type previously described, rotates about a center of rotation labelled "CR". The centrifuge rotor housing 142 supports two flexible bags 144 and 146 in a vertical position on the periphery of the rotor and equidistant from the center of rotation.

A contoured framework 150 with concave inwardly extending surfaces, allows bag 144 to rest naturally against the housing inner surface with a minimum of stress on the bag wall material when subjected to centrifugation. Alignment pins (not shown) keep the bag 144 properly oriented. Inner wall 152 of bag 144 is essentially free-standing except for a light weight, stiff, curved pressure plate 148 disposed against the surface of inner wall 152 so as to produce a liquid pressure in the bag when subjected to the centrifugal field.

Interconnecting tubing 154 is provided between the exit port of first bag 144 and the second bag 146 (in this case the receiver container). This tubing passes over a curvilinear contour (or dam) 156 which may be incorporated into the framework 150.

This contour is sufficiently large to assure that the exit port of bag 144 is at a lesser distance from the center of rotation than any other portion of the bag 155. Furthermore, the shape of the container is such that the fluid pathway in the first bag near the exit port is in the form of an approach ramp with gradually decreasing radius for locations progressively closer to the exit port.

The second bag 146 is merely a receiving container for the separated component from the first bag. The volume of this container is pre-established to just accomodate the volume of separated component (supernatant) desired to be recovered from bag 144. Suitable support means (not shown) hold bag 146 in place against rotor housing 142. Flow from bag 144 to bag 146 is terminated by setting the volume of the second bag 146 so that it is filled completely before all the supernatant has passed from the first bag 144.

For high yield application, for example, in the separation of plasma from whole blood, an accurate predetermination would be required of the volume of supernatant to be expected from the separation as, for example, by determining the hematocrit of the anticoagulated whole blood when preparing for separation of whole blood into plasma and RBC. An alternate way of providing an accurate automatic cut is to select a pressure plate 148 with a weight sufficient to force supernatant, such as plasma, over into the receiver container (bag 146) but not great enough to force the more dense components such as RBC into bag 146.

The pressure in the first bag is proportional to the difference between the squares of the radii to the input and output of the fluid column, to the density of the fluid in the column, and to the square of the rotating speed.

The density of packed PBC is about 1.10, whereas the density of the supernatant plasma is about 1.03. Greater pressure is therefore required to force red cells radially inward to a given radial point than is required to force plasma at this point. Therefore, when the cut is being made, flow from bag 144 to bag 146 will automatically cease when RBC pass part of the way through the radial passage 154 to the second bag 146, provided the weight of pressure plate 148 is suitably matched to the process.

As in the earlier described embodiments, it is important that, to make a clean separation, it is necessary to run the centrifuge long enough to generate clear supernatant before allowing any flow to occur through the interconnecting pathway 154 between the first bag 144 and second compartments 146. In other words, it is necessary to avoid a situation in which the fluid in the interconnecting pathway 154 is close to the density of supernatant but still has some cells suspended in it. Thus, it is evident that the operating protocol must include a first period of centrifugation while the interconnecting tubing is clamped shut as by the previously described timer mechanism 15 or equivalent. Then the clamp may be opened and clear supernatant may be passed over into the bag in the second compartment 146 until packed RBC flow part way through the interconnecting pathway.

Figure 16:
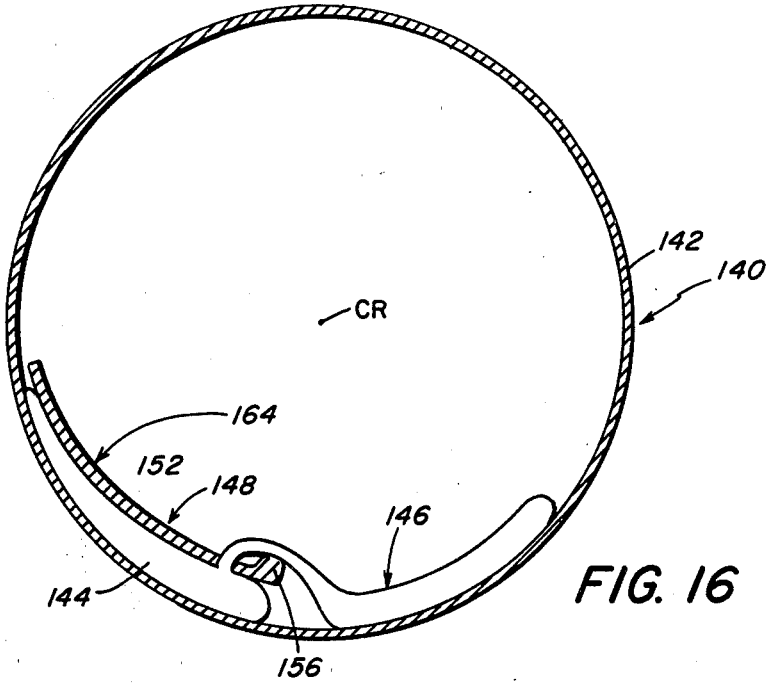
FIG. 16 is a simplified schematic top view of a pressure plate type centrifuge showing a further alternate embodiment of FIG. 15.

FIG. 16 is an improved version of the FIG. 15 apparatus wherein the pressure plate 148 is made large enough in surface area to cover the entire area of wall surface 152 of first blood processing bag 144, thus no bulging is possible. Additionally, the center of gravity of pressure plate 148 is off-centered slightly to a point labelled 164; thereby automatically providing a more optimal separation zone. The center of gravity may be off-set by contouring the shape of plate 148 or by adding or subtracting material from the plate as required. The dam or ramp 156 previously located on the rotor housing is now located on the pressure plate 152 and moves with the plate thereby providing a more constant ramp function.

In summary, in the apparatus described in connection with FIG. 16, no specialized contoured outer shoe and frame is necessary. Instead, the blood processing bag 144 can be simply inserted against the inner wall 142 of the rotor. An optimal separation compartment is automatically created by use of a pressure plate 148 with an off-centered center of gravity. Alterations in the separation zone can be made very simply by merely adding or repositioning tiny weights (not shown) on the pressure plate 148.

Figure 17:
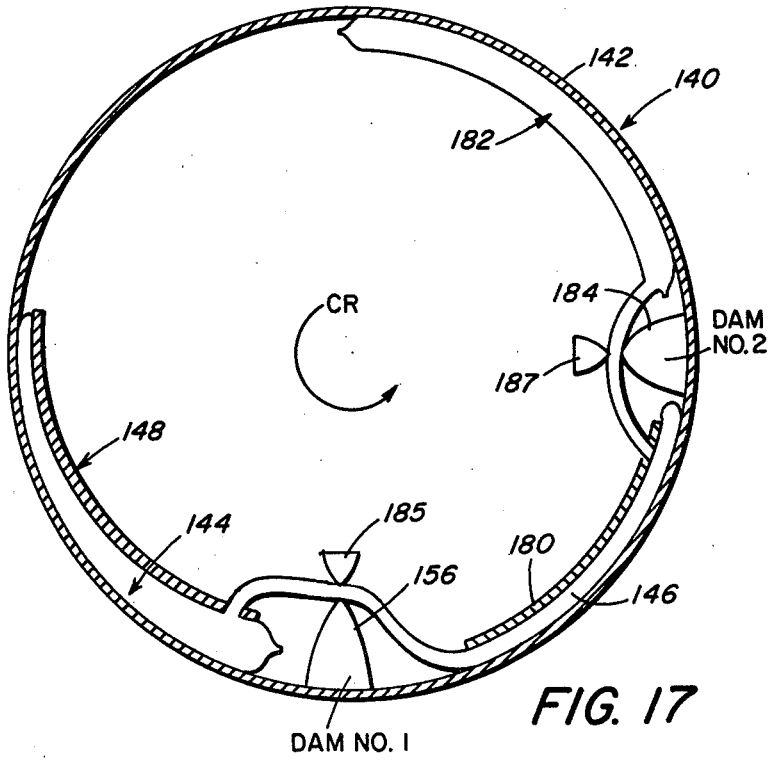
FIG. 17 is a simplified top view of a pressure plate type centrifuge showing a two step separation process.

It should be understood that while only two bags are used for illustration in FIGS. 15–16, the separation process may be extended in a variety of ways as shown for example in FIG. 17 by adding a pressure plate 180 on bag 146 and interconnecting bag 146 over a second dam 184 to a third bag 182. A process similar to the three bag pheresis process described in connection with FIGS. 1–8 may then be carried out by clamping the interconnecting tubing with clamps 185 and 187 at appropriate intervals and centrifugally separating RBC and plasma from whole blood in bag 144. The plasma is then expressed to bag 146 by means of a pressure plate 148 having a mass just sufficient to express the lighter weight plasma sideways over the dam 156 and into bag 146. Next, the plasma in bag 146 is centrifugally separated into PRP and PPP. Finally, the PPP is expressed sideways over the second dam 184 by the force of pressure plate 180 which is preestablished so as to express all but a fixed volume of fluid, for example 50 ml, into the third bag 182.

The clamps 185 and 187 may be controlled by a hydraulic timer mechanism as described earlier.

A typical procedure is as follows:

(1) Whole blood is contained in bag 144, clamps 185 and 187 are closed to prevent flow. The centrifuge 140 spins at a low r.p.m. of about 1000 r.p.m. for a few minutes.

(2) Clamp 185 opens and allows plasma to flow into bag 146.

(3) Clamp 185 closes and the rotor speed increases to two or three times the low r.p.m. for a few minutes.

(4) Clamp 187 opens and cell-free plasma PPP flows into bag 182.

(5) Clamp 187 closes and the centrifuge stops.

Figure 18:
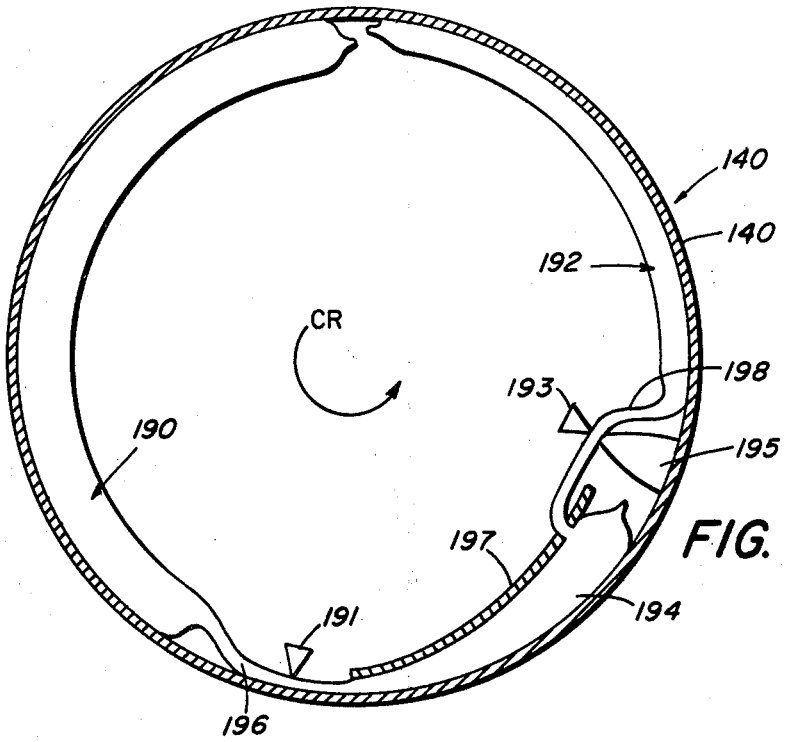
FIG. 18 is a simplified top sectional view of a pressure plate type centrifuge showing a cell washing embodiment.

Another application of the invention is shown in the embodiment of FIG. 18 which illustrates red blood cell washing apparatus. In FIG. 18 three flexible bags 190, 192, and 194 are disposed about the periphery of the rotor housing 142 of centrifuge 140 equidistant from the center of rotation CR. Bag 190 contains a washing solution, such as a solution of sterile saline. Bag 194 is interconnected with bag 190 by tubing 196 and with spent solution bag 192 by tubing 198 which extends over dam 195. Clamp means 191 and 193 operated by a timer mechanism (not shown) control the flow of fluid through respective tubing 196 and 198.

Bag 194 is substantially similar to the blood processing bags previously described. It contains the whole blood or thawed glyceralized blood to be washed.

A typical procedure is as follows:

(1) Clamps 191 and 193 are closed and the centrifuge 140 is brought up to a running speed of about 2000 r.p.m. for a few minutes.

(2) Clamp 193 is opened and separated plasma and/or freezing solutions and saline are expressed from bag 194 through tubing 198 into the spent wash solution bag 192 by the pressure generated by the pressure plate 197.

(3) Clamp 193 is closed and clamp 191 is opened, filling the blood processing bag with wash solution. Clamp 193 then closes.

(4) The centrifuge is then spun for a pre-determined time period or stopped and agitated to mix the blood/-wash solution mixture for a time period (similar to the conventional washing machine agitation cycle) and then brought up to a speed of 2000 r.p.m. for a period of time.

(5) Clamp 193 is then opened and the pressure plate 197 expresses the spent wash solution from bag 194 into bag 192, as the rotor spins.

(6) This procedure would be repeated a number of times until adequate washing has taken place.

The final product of this procedure is a unit of packed washed red cells. The hematocrit of the packed cells can be made very high. The clamps for this procedure may be controlled by the hydraulic timer clamp mechanism previously mentioned.

An alternative to the procedures heretofore described for controlling the flow of fluids between first and second bags is shown in the embodiment of FIG.

19. In this embodiment opto/electronic/mechanical means are employed in place of, for example, the hydraulic timer and pheresis valve components previously mentioned.

Figure 19:
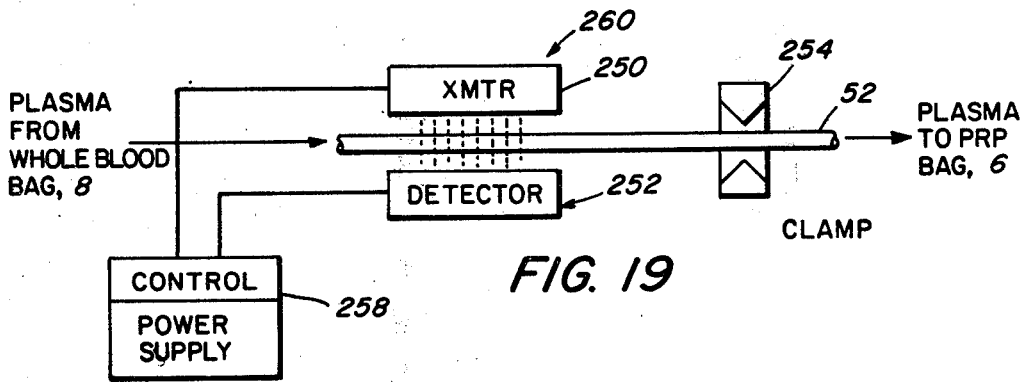
FIG. 19 is a schematic diagram of an embodiment of the invention utilizing an optoelectronic device for controlling flow.

The apparatus described in FIG. 19 is illustrated in connection with the present apparatus, however, the invention described in this embodiment may be applied to a variety of blood processing apparatus and methods.

In the simplified schematic of FIG. 19, the interconnecting tubing 52 between whole blood bag 8 and PRP bag 6 is shown disposed between a light transmitter element 250 and photo-detector 252 of a well-known beam optical sensor 260. Beam sensor 260 may alternatively comprise a simple reflective optical beam sensor. Tubing 52 also passes between a solenoid activated flow clamp 254.

When fluid in tubing 52 changes color, such as when all the plasma (yellow in color) has passed through the tubing 52 from whole blood bag 8 as a result of the centrifugally induced siphon effect previously described, a change in voltage will occur at the output lead of photodetector 252 as the red colored RBC's start to pass. The color change is sensed by the photodetector 252 which generates a voltage signal. This voltage signal is coupled to power supply/control module 258 which in turn energizes the coils of a solenoid mounted on clamp 254 thereby causing the clamp to stop the flow through tubing 52.

Thus, when the flow from the blood processing bag 8 turns from yellow to red, the component line 52 will be clamped. This will trap the RBC's in the whole blood bag 8 and the plasma in the PRP bag 6. Similar apparatus can be used to sense the color change between PPP and PRP to actuate an additional clamp on the tubing 54 between the PRP bag and PPP bag.

EQUIVALENTS

Those skilled in the art may recognize other equivalents to the specific embodiments described herein, which equivalents are intended to be encompassed by the claims attached hereto.

We claim:

1. Apparatus for processing fluids in a centrifugal force field to separate constituent components of such fluids comprising in combination:
   (a) a centrifuge having a rotor adapted to rotate at a sufficient speed to cause said components to separate;
   (b) a flexible bag adapted to contain a first fluid;
   (c) a receiver container adapted to receive at least one component of said first fluid;
   (d) mass means disposed nearer the center of rotation of the rotor than the flexible bag and adapted to move and contact a surface of said bag, said mass being sufficient to at least initiate a flow from said bag to said container of component fluid separated in said bag.

2. The apparatus of claim 1 in which the bag and container are located on the rotor substantially equidistant from the center of rotation.

3. The apparatus of claim 1 in which the force exerted by the mass means is just sufficient to force the component with the least specific gravity from the bag to the container.

4. The apparatus of claim 1 in which the bag is located radially inward from the container.

5. The apparatus of claim 1 in which control means are provided for stopping the flow of fluid when substantially the entire volume of fluid component of a predetermined characteristic has left said bag.

6. The apparatus of claim 5 in which the characteristic of the fluid is an optical property.

7. The apparatus of claim 6 in which the control means is electrically actuated.

8. The apparatus of claim 5 in which the characteristic of the fluid is specific gravity.

9. The apparatus of claim 1 in which red blood cells are washed in the flexible bag and the component fluid which flows to the container is spent wash solution.

10. The apparatus of claim 1 in which whole blood is separated in the flexible bag and the component fluid which flows to the container is plasma.

11. The apparatus of claim 10 including control means for stopping the flow to the container when substantially all the plasma has left the bag.

12. The apparatus of claim 11 in which the control means comprises a valve controlled by the specific gravity of fluid flowing from the flexible bag.

13. The apparatus of claim 12 in which the valve means comprises a float valve.

14. The apparatus of claim 1 in which platelet rich plasma is separated in the flexible bag and the component fluid which flows to the container is platelet poor plasma.

15. The apparatus of claim 1 in which the receiver container is a flexible bag with an input and output port and a second container is coupled to the output port to receive a fluid component separated in the first recited receiver container.

16. The apparatus of claim 15 in which PRP and RBC are separated in the first flexible bag and the PRP flows to the first recited receiver container where the platelets are separated and PPP flows to the second container while the platelets remain.

17. The apparatus of claim 15 in which valve means are provided to prevent flow after fluid component separation is achieved in said first container.

18. The apparatus of claim 17 in which the valve means comprises a float valve having a float with a specific gravity intermediate that of the components being separated.

19. The apparatus of claim 1 in which the receiver container is also flexible and a second mass means is movably disposed adjacent thereto nearer the center of rotation of the rotor than said receiver container.

20. The apparatus of claim 19 including
   (e) a second receiver container disposed on said rotor and adapted to receive at least one component of fluid separated in said first recited receiver container.

21. The apparatus of claim 19 in which said first recited receiver container has an inlet port and outlet port separated by a barrier.

22. The apparatus of claim 19 in which the bag and the flexible container are suspended between the mass means and support members.

23. The apparatus of claim 19 in which a flexible gasket is interposed between the flexible container and support member thereby providing a barrier to the flow of component from said container when the mass means compresses the gasket.

24. Apparatus for processing fluids in a centrifugal force field to separate constituent components of such fluids comprising in combination:

(a) a centrifuge having a rotor adapted to rotate at a sufficient speed to cause said components to separate;
(b) a flexible bag adapted to contain a first fluid;
(c) a receiver container adapted to receive at least one component of said first fluid;
(d) mass means disposed nearer the center of rotation of the rotor than the flexible bag and adapted to move and contact a surface of said bag, said mass being sufficient to at least initiate a flow from said bag to said container of component fluid separated in said bag; and clamp means to prevent fluid flow from said bag to said container until a predetermined level of fluid processing has been achieved by rotation of said rotor.

25. A method comprising:
(a) rotating a volume of whole blood contained in a first flexible bag in a centrifuge at a speed sufficient to separate said whole blood into at least a less dense and more dense component;
(b) forcing the less dense component to flow from said bag to a container by applying centrifugal force to a moveable body of fixed weight in direct contact against a planar surface of said bag while said volume is being rotated;
(c) preventing the flow in step (b) until substantial separation occurs in step (a) and;
(d) causing said flow to stop when the less dense component has passed from the first bag to the second bag.

26. The method of claim 25 in which the flow is stopped in step (d) by control means responsive to the density of one of said components.

27. The method of claim 25 in which the flow is stopped in step (d) by providing the body of step (b) with enough weight to displace the less dense component and not the more dense component.

28. The method of claim 25 in which the flow is stopped in step (d) by a sensor responsive to optical change as different blood components pass the sensor.

29. In a process wherein blood is separated into a first blood component and second blood component in a blood processing chamber and first blood component is thereafter caused to flow through an outlet port of said chamber through a conduit and into a receiver container:
the improvement of causing said flow by a plate disposed adjacent said chamber, which plate is caused to move against said chamber under the influence of centrifugal force and thereby exert a force on said chamber sufficient to cause said flow.

30. The improvement of claim 29 in which the conduit between said chamber and container has an inner diameter sufficiently small to cause the second blood component to achieve a flow velocity which will cause any air bubbles in the conduit to flow to said container.

31. The improvement of claim 29 in which the first blood component is plasma and the second component is red blood cells.

32. The improvement of claim 29 in which the chamber comprises a flexible bag.

33. In a process wherein blood is separated into a first blood component and second blood component in a blood processing chamber and first blood component is thereafter caused to flow through an outlet port of said chamber through a conduit and into a receiver container:
the improvement of causing said flow by a plate disposed adjacent said chamber and wherein flow is stopped to the container with a valve means having a stopper with a specific gravity which allows it to float on the interface between first and second blood components within said chamber.

34. The improvement of claim 33 in which the valve means is located in the chamber adjacent the outlet port.

35. Apparatus for processing fluids in a centrifugal force field to separate constituent components of such fluids comprising in combination:
(a) a centrifuge having a rotor adapted to rotate at a sufficient speed to cause said components to separate;
(b) a flexible bag adapted to contain whole blood;
(c) a receiver container adapted to receive plasma component separated from said whole blood;
(d) mass means disposed nearer the center of rotation of the rotor than the flexible bag and adapted to move and contact a surface of said bag, said mass being sufficient to at least initiate a flow from said bag to said container of component fluid separated in said bag; and
(e) control means for stopping the flow to the receiver container when substantially all the plasma has left the flexible bag; said control means comprising a valve controlled by the specific gravity of the plasma.

36. The apparatus of claim 35 in which the valve means comprises a float valve.

37. Apparatus for processing fluids in a centrifugal force field to separate constituent components of such fluids comprising in combination:
(a) a centrifuge having a rotor adapted to rotate at a sufficient speed to cause said components to separate;
(b) a flexible bag adapted to contain a first fluid;
(c) a receiver container adapted to receive at least one component of said first fluid;
(d) mass means disposed nearer the center of rotation of the rotor than the flexible bag and adapted to move and exert a force against a surface of said bag, said force being sufficient to at least initiate a flow from said bag to said container of component fluid separated in said bag; an
(e) said flexible bag having a generally planar shape with a relatively short transverse internal width between planar walls of the bag, such bag being disposed within said centrifuge in a substantially arcuate vertical position such that the short internal width of the bag is positioned transverse to the axis of rotation of the centrifuge.

38. Apparatus for processing fluids in a centrifugal force field to separate constituent components of such fluids comprising in combination:
(a) a centrifuge having a rotor adapted to rotate at a sufficient speed to cause said components to separate;
(b) a first flexible bag adapted to contain a first fluid;
(c) a second flexible bag with an input port for receiving a fluid component separated in said second flexible bag at least one component of said first fluid;
(d) a receiver container adapted to receive a fluid component separated in said second flexible bag;
(e) mass means disposed nearer the center of rotation of the rotor than the first flexible bag and adapted to move and contact a surface of said bag, said mass being sufficient to at least initiate a flow from said bag to said container of component fluid separated in said first flexible bag; and (f) valve means for preventing flow after fluid component separation is achieved in said first second flexible bag.

39. The apparatus of claim 38 in which the valve means comprises a float valve having a float with a specific gravity intermediate that of the components separated.

* * * * *